US007113143B2

(12) United States Patent
Minemura

(10) Patent No.: US 7,113,143 B2
(45) Date of Patent: Sep. 26, 2006

(54) LOOP ANTENNA AND RADIO COMMUNICATION DEVICE HAVING THE SAME

(75) Inventor: Takashi Minemura, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 29 days.

(21) Appl. No.: 10/948,967

(22) Filed: Sep. 24, 2004

(65) Prior Publication Data

US 2005/0151690 A1 Jul. 14, 2005

(30) Foreign Application Priority Data

Jan. 13, 2004 (JP) ..... 2004-005438

(51) Int. Cl.
*H01Q 7/00* (2006.01)
*H01Q 1/24* (2006.01)
*H01Q 21/00* (2006.01)

(52) U.S. Cl. ..... 343/870; 343/702; 343/867

(58) Field of Classification Search ..... 343/702, 343/742, 866, 867, 870
See application file for complete search history.

(56) References Cited

U.S. PATENT DOCUMENTS

| | | | | |
|---|---|---|---|---|
| 5,557,293 | A | 9/1996 | McCoy et al. | |
| 5,608,417 | A * | 3/1997 | de Vall | 343/895 |
| 5,767,809 | A | 6/1998 | Chuang et al. | |
| 6,104,354 | A * | 8/2000 | Hill et al. | 343/744 |
| 6,118,411 | A * | 9/2000 | Hasegawa et al. | 343/744 |
| 6,600,450 | B1 | 7/2003 | Efanov et al. | |
| 2003/0020661 | A1 | 1/2003 | Sato | |
| 2003/0174098 | A1 | 9/2003 | Noro et al. | |

FOREIGN PATENT DOCUMENTS

| | | | |
|---|---|---|---|
| EP | 0 786 824 | A1 | 7/1997 |
| EP | 1 280 232 | A1 | 1/2003 |
| JP | 58-134505 | A | 8/1983 |
| JP | 5-335826 | A | 12/1993 |
| JP | 7-86821 | A | 3/1995 |
| JP | 7-162630 | A | 6/1995 |
| JP | 9-181520 | A | 7/1997 |
| JP | 10-513629 | A | 12/1998 |
| JP | 2000-196337 | A | 7/2000 |
| JP | 2001-514777 | A | 9/2001 |
| JP | 2005-528012 | A | 9/2005 |

OTHER PUBLICATIONS

Chi-Chang, et al. "A 2.4 GHz Omni-directional Horizontally Polarized Planar Printed Antenna for WLAN Applications" vol. 2, 2003 Digest, IEEE Antennas and Propagation Society International Symposium, Columbus, Ohio, Jun. 22-27, 2003, ISBN: 0-7803-7846-6 pp. 42-45.

* cited by examiner

*Primary Examiner*—Shih-Chao Chen
(74) *Attorney, Agent, or Firm*—Frishauf, Holtz, Goodman & Chick, P.C.

(57) ABSTRACT

In a loop antenna of this invention, a plurality of segments are arranged in a loop while overlapping each other at end portions, a dielectric medium is inserted between the overlap portions of the segments to capacitively couple the segments, and a feed circuit is connected to at least one of the segments.

18 Claims, 13 Drawing Sheets

X-Y plane, radiation pattern (0.9GHz)
(Gpeak = 0.319855 = -5.0dBi (0.9GHz))

Y-Z plane, radiation pattern (1.0GHz)
(Gpeak = -1.57704dBi (1GHz))

LOOP ANTENNA AND RADIO COMMUNICATION DEVICE HAVING THE SAME

CROSS-REFERENCE TO RELATED APPLICATIONS

This application is based upon and claims the benefit of priority from prior Japanese Patent Application No. 2004-005438, filed Jan. 13, 2004, the entire contents of which are incorporated herein by reference.

BACKGROUND OF THE INVENTION

1. Field of the Invention

The present invention relates to a loop antenna suitable for a mobile communication terminal such as a cellular phone or PDA (Personal Digital Assistants) and a radio communication device having the loop antenna.

2. Description of the Related Art

Recent mobile communication terminals such as cellular phones and PDAs use internal antennas having an antenna element accommodated in a housing from the viewpoint of further size reduction and design of terminals. However, an internal antenna readily degrades its performance in the voice communication posture, as compared to an antenna arranged outside the housing.

The antenna performance can deteriorate in the voice communication posture due to two reasons below.

(1) During voice communication, the terminal housing readily comes close to the speaker as a lossy dielectric medium. Since the transmission radio wave absorption amount in the lossy dielectric medium increases, the radiation efficiency decreases.

(2) During voice communication, the terminal housing is often tilted obliquely or horizontally. For this reason, the reception efficiency for a vertical polarized wave arriving from the base station decreases.

In addition, the antenna radiation pattern changes depending on the tilt angle of the terminal housing in the voice communication posture. This also poses a problem in maintaining a stable voice communication state.

So use of a traditional small circular loop antenna could be preliminary approach to examine. A small circular loop antenna is formed by a 0.1-wavelength antenna segment having a ring shape. With this antenna, a radiation pattern with radiation suppressed in a direction toward the speaker can be obtained. In addition, a predetermined antenna gain can be held independently of the tilt angle of the terminal housing during voice communication. However, since the small circular loop antenna has a short circumferential length, the radiation resistance is low, and the aperture area is small. For this reason, impedance matching to a radio circuit is difficult to ensure.

On the other hand, as an internal antenna of another type suitable for mobile communication terminals, a dipole antenna which has a Z- or H-shaped segment and supplies power at the central segment portion has been proposed in, e.g., U.S. Pat. No. 5,767,809 or Chi-Chang, et al, "A 2.4 GHz Omni-directional Horizontally Polarized Planar Printed Antenna for WLAN Applications", 2003 IEEE. An antenna of this type can obtain a radiation pattern similar to that of a small circular loop antenna. In addition, impedance matching to a radio circuit can easily be ensured.

However, an antenna of this type has a segment at the antenna central portion and supplies power on the central segment. It is therefore difficult to use this antenna in a radio communication device having a large circuit component mounted at the central portion of the housing, like a folding cellular phone having a back display.

As described above, the conventionally developed or proposed internal antennas can hardly obtain impedance matching to a radio circuit because of their low radiation resistance and small aperture area. In addition, since a central segment and power supply at the central portion of the segment are necessary, the degree of freedom in mounting is low. For this reason, the antennas are not appropriate for compact radio communication devices having many restrictions on mounting, like a cellular phone having a back display.

BRIEF SUMMARY OF THE INVENTION

It is an object of the present invention to provide a loop antenna which can obtain an ideal radiation pattern and also easily obtain impedance matching to a radio circuit and increases the degree of freedom in mounting by eliminating the necessity of the central segment and power supply at its central portion, and a radio communication device having the loop antenna.

In order to achieve the above object, according to one aspect of the present invention, in a loop antenna, a plurality of segments are arranged in a loop, the segments are capacitively coupled, and a feed circuit is connected to least one of the plurality of segments.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

First Embodiment

Figure 1:
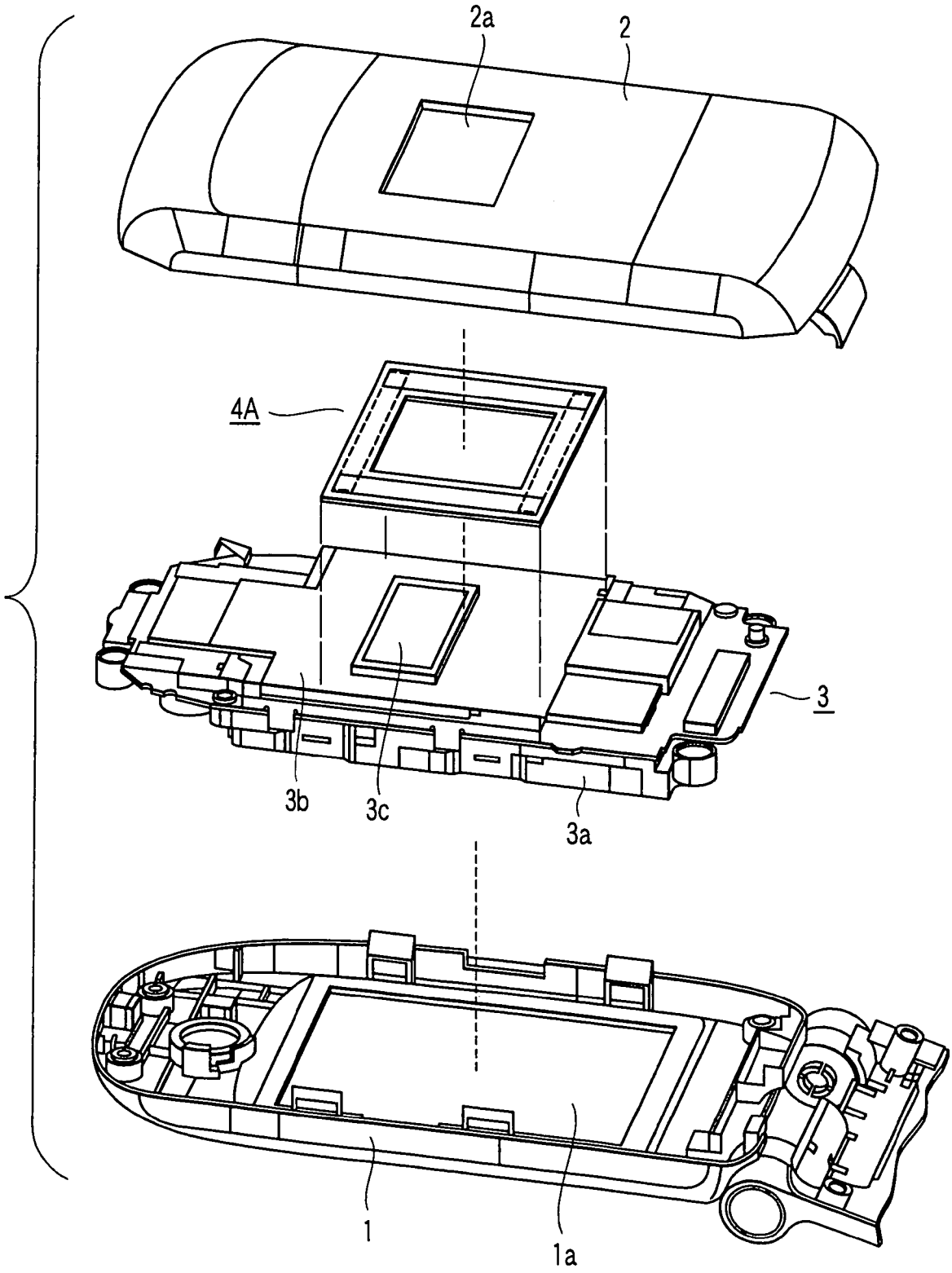
FIG. 1 is an exploded perspective view showing a radio communication device having a loop antenna according to the first embodiment of the present invention.

FIG. 1 is an exploded perspective view showing a radio communication device having a loop antenna according to the first embodiment of the present invention. The radio communication device of the first embodiment is a folding cellular phone. FIG. 1 shows only the upper structure. The lower structure in which a keypad and the like are arranged is not illustrated.

Referring to FIG. 1, reference numeral 1 denotes a front cover. A display window 1*a* for main display is arranged in the front cover. Reference numeral 2 in FIG. 1 denotes a back cover. A display window 2*a* for sub-display is arranged on the back cover 2. The front cover 1 and back cover 2 form an upper housing. A circuit unit 3 is accommodated in the upper housing. In the circuit unit 3, a main display (not shown), a printed circuit board 3*b* to which circuit elements are attached, and a sub-display 3*c* are mounted in a case 3*a*.

Figure 2A:
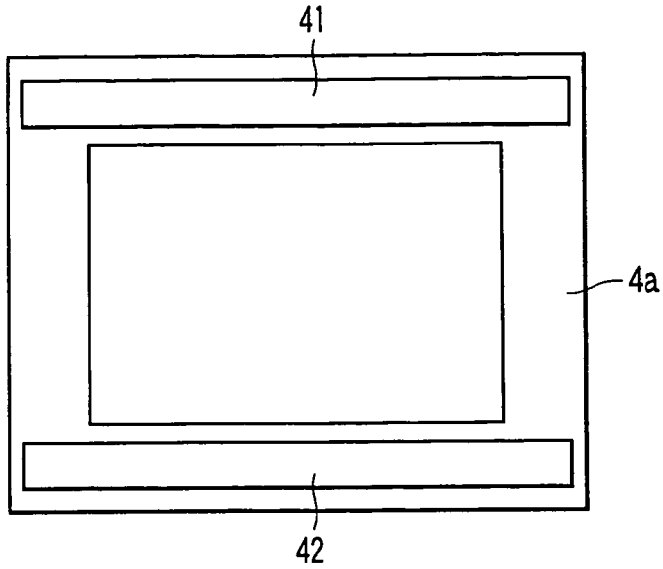
FIGS. 2A, 2B, and 2C are enlarged views showing the structure of the loop antenna shown in FIG. 1.
Figure 2B:
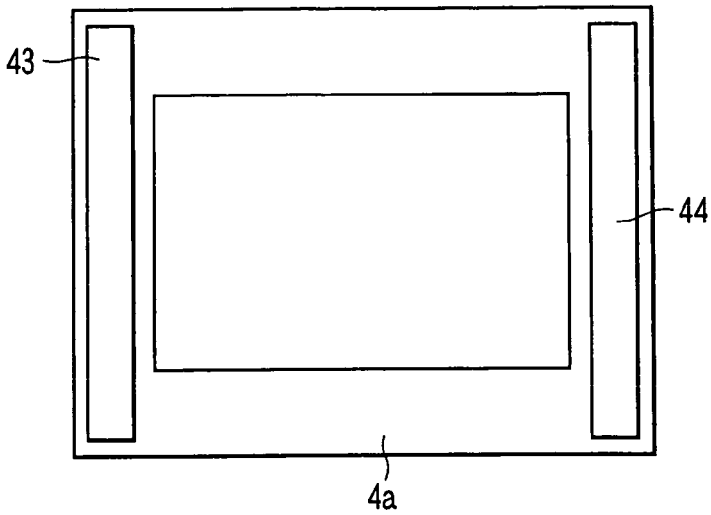
Figure 2C:
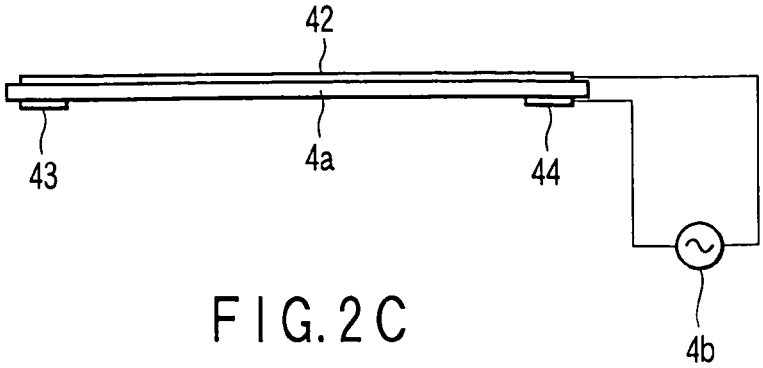

A loop antenna 4A is arranged on the printed circuit board 3*b* of the circuit unit 3 and surrounds the sub-display 3*c*. FIGS. 2A, 2B, and 2C are respectively a plan view, a bottom view, and a side view of the loop antenna 4A.

As shown in FIGS. 2A, 2B, and 2C, the loop antenna 4A has conductive patterns 41 and 42 formed on a pair of opposing pieces on the first surface (upper surface) of a double-sided printed circuit board 4*a* having a frame shape. In addition, conductive patterns 43 and 44 are formed on a pair of opposing pieces on the second surface (lower surface). The conductive patterns 41 and 42 and conductive patterns 43 and 44 form the segments of the antenna.

The end portions of the conductive patterns 41 and 42 and conductive patterns 43 and 44 are arranged to oppose each other via the double-sided printed circuit board 4*a*. Accordingly, the conductive patterns 41, 42, 43, and 44 are capacitively coupled at the opposing portions, i.e., overlap portions through the dielectric of the double-sided printed circuit board 4*a*.

A feed terminal is arranged at the overlap portion between the conductive patterns 42 and 44 at an arbitrary corner of the loop antenna 4A. The feed terminal is connected to a radio circuit 4*b* through a feed line pattern (not shown). The radio circuit 4*b* and the feed line pattern are mounted and formed on the printed circuit board 3*b* of the circuit unit 3. Accordingly, unbalanced feed is done from the radio circuit 4*b* to the loop antenna 4A through the feed line pattern.

The total length of the conductive patterns 41 to 44 is set to 0.2 to 2.0 wavelength with respect to the free space wavelength of the transmission/reception frequency. The length of each of the conductive patterns 41 to 44 is set to be equal to or less than 0.4 wavelength with respect to the free space wavelength of the transmission/reception frequency. The distance between the conductive patterns at each overlap portion is set to be equal to or less than 0.1 wavelength with respect to the free space wavelength of the transmission/reception frequency.

Figure 3:
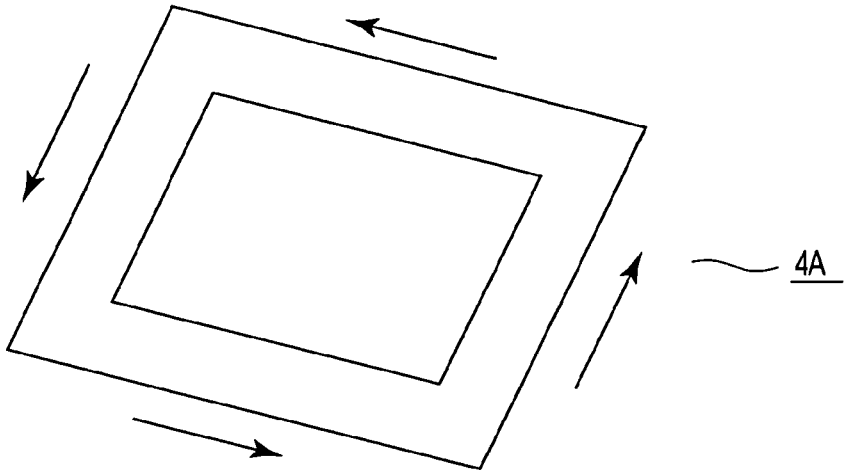
FIG. 3 is a view showing a current distribution in the loop antenna shown in FIG. 1.
Figure 4A:
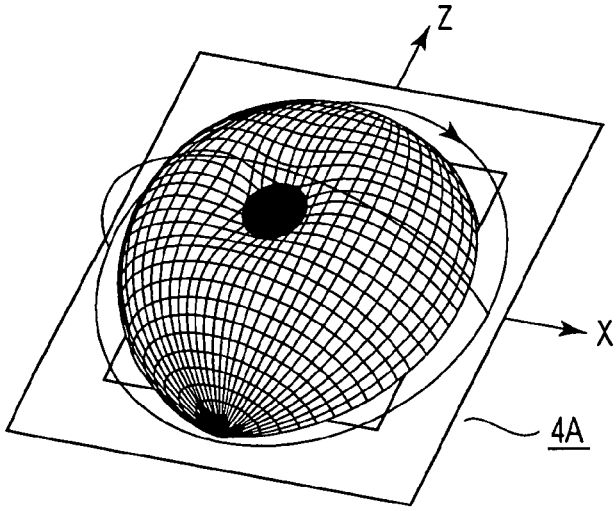
FIGS. 4A and 4B are views showing a three-dimensional expression of the radiation pattern by the loop antenna shown in FIG. 1.
Figure 4B:
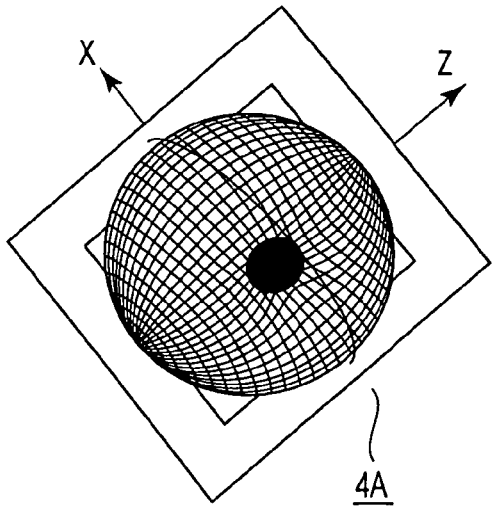

In the above-described structure, when a power is supplied to the loop antenna 4A, in-phase currents flow to the conductive patterns 41 to 44 which form the segments because they are capacitively coupled with each other. FIG. 3 shows the current distribution. The radiation pattern has a so-called doughnut shape or an almost erythrocyte (hemoglobin) shape in which a sphere is recessed at its central portion in the vertical direction with respect to the antenna surface, as shown in FIGS. 4A and 4B.

Figure 5A:
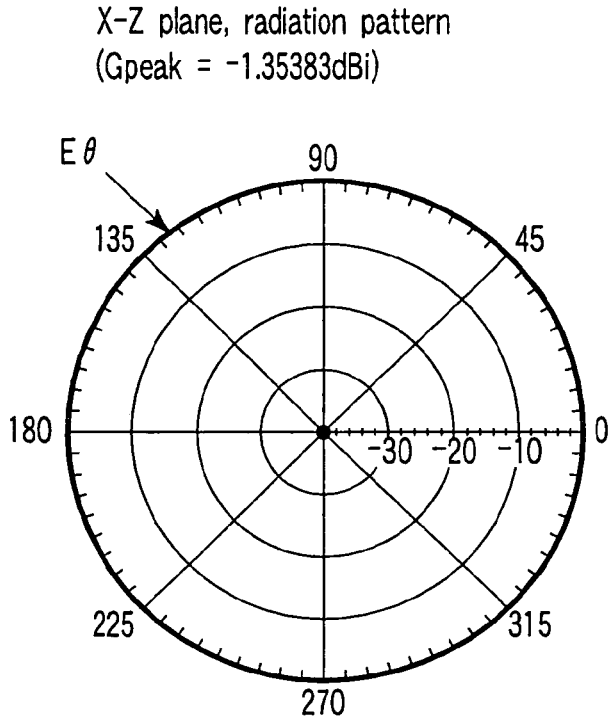
FIGS. 5A and 5B are views showing the radiation pattern in the X-Z plane of the loop antenna shown in FIG. 1.
Figure 5B:
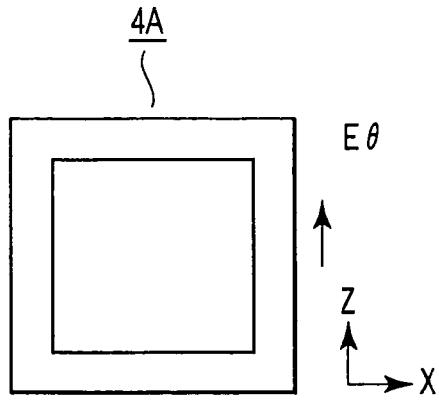
Figure 6A:
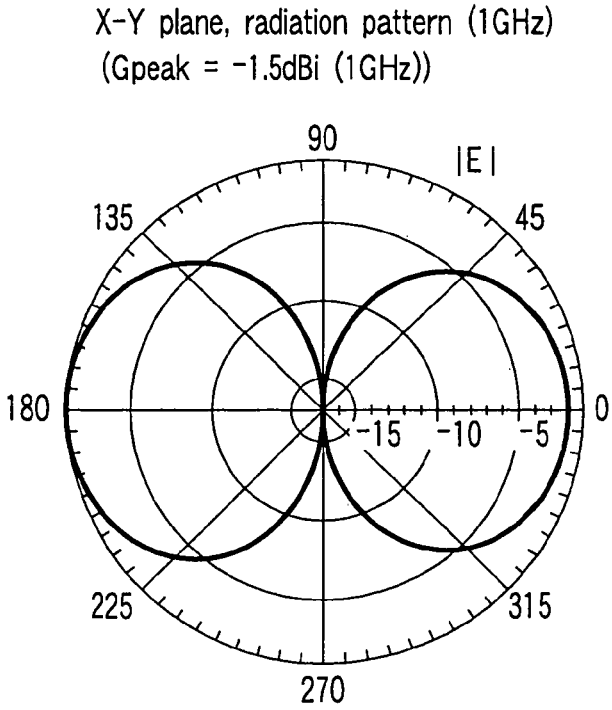
FIGS. 6A and 6B are views showing the radiation pattern at 1.0 GHZ in the X-Y plane of the loop antenna shown in FIG. 1.
Figure 6B:
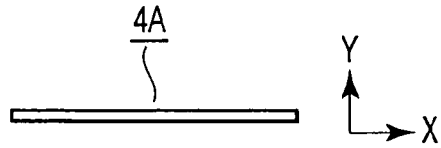
Figure 7A:
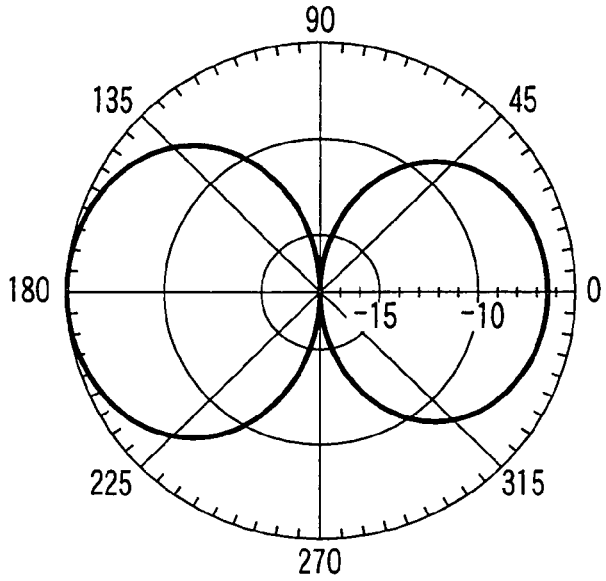
FIGS. 7A and 7B are views showing the radiation pattern at 0.9 GHz in the X-Y plane of the loop antenna shown in FIG. 1.
Figure 7B:
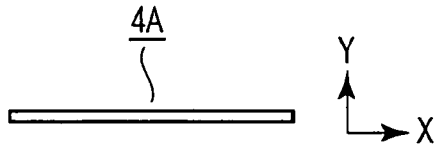
Figure 8A:
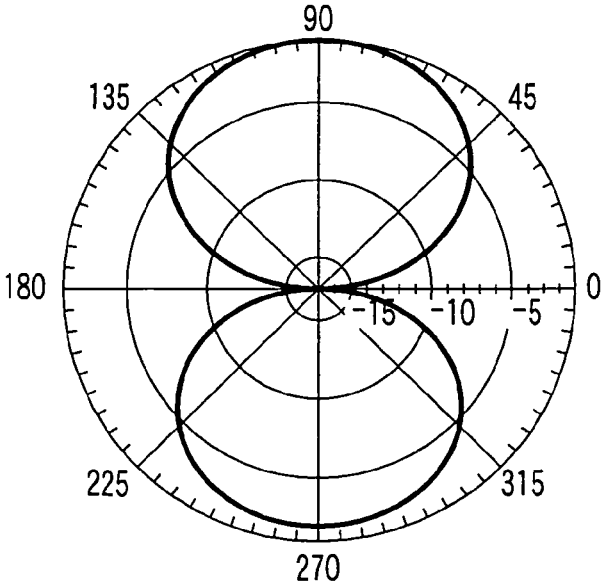
FIGS. 8A and 8B are views showing the radiation pattern in the Y-Z plane of the loop antenna shown in FIG. 1.
Figure 8B:
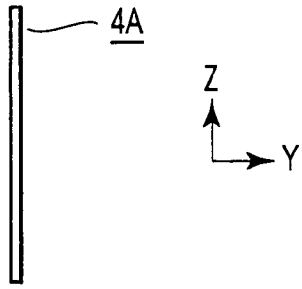

FIGS. 5A and 5B are views showing the radiation characteristic of the radiation pattern in the horizontal plane (X-Z plane in FIGS. 5A and 5B) of the antenna. As is apparent from FIGS. 5A and 5B, the radiation pattern in the horizontal plane of the antenna maintains omni-directional properties. FIGS. 6A and 6B show the radiation characteristic of the radiation pattern in the vertical plane (X-Y plane in FIGS. 6A and 6B) of the antenna. FIGS. 8A and 8B show the radiation characteristic of the radiation pattern in the vertical plane (Y-Z plane in FIGS. 8A and 8B) of the antenna. As is apparent from FIGS. 6A, 6B, 8A, and 8B, the radiation pattern in the vertical plane of the antenna obtains only a directivity in the horizontal directions X and Z. No radiation occurs along the vertical direction Y. FIGS. 6A and 6B show the characteristic when the transmission/reception frequency is 1.0 GHz. Even when the transmission/reception frequency is 0.9 GHz, a radiation pattern having a similar characteristic is obtained, as shown in FIGS. 7A and 7B.

That is, the distributed capacitance loop antenna 4A according to the first embodiment can generate a radiation pattern which maintains omni-directional properties in a plane parallel to the antenna surface and has a directivity with null sensitivity in a direction perpendicular to the antenna surface independently of the circumferential length of the loop. When this loop antenna is used for a cellular phone, the influence and loss by a human body as a lossy dielectric medium are small. In addition, a predetermined antenna gain can be obtained independently of the tilt angle of the terminal housing during voice communication.

Since the circumferential length of the loop antenna can arbitrarily be set, the radiation resistance of the antenna can be set to a value close to the impedance (e.g., 50 Ω) on the feed side of the radio circuit. For this reason, impedance matching to the radio circuit 4*b* can easily be ensured, as compared to a small circular loop antenna having a specific loop antenna circumferential length.

In addition, neither central segment nor power supply on the central segment are necessary, unlike the Z- or H-shaped antenna. Hence, even in the folding cellular phone having the sub-display 3*c* on the rear surface, as shown in FIG. 1, the loop antenna 4A can be arranged around the sub-display 3*c*. Accordingly, the degree of freedom in mounting can be increased.

In addition, in this embodiment, the four conductive patterns 41 to 44 are formed as segments to form a square loop by using the both surfaces of the double-sided printed circuit board 4*a* having a frame shape. The conductive patterns 41 to 44 are capacitively coupled by making their end portions overlap via the double-sided printed circuit board 4*a*. Hence, no circuit components such as distributed capacitors need be separately prepared for capacitive coupling of the segments. Accordingly, the distributed capacitance loop antenna 4A can easily be manufactured at a low cost.

Second Embodiment

Figure 9:
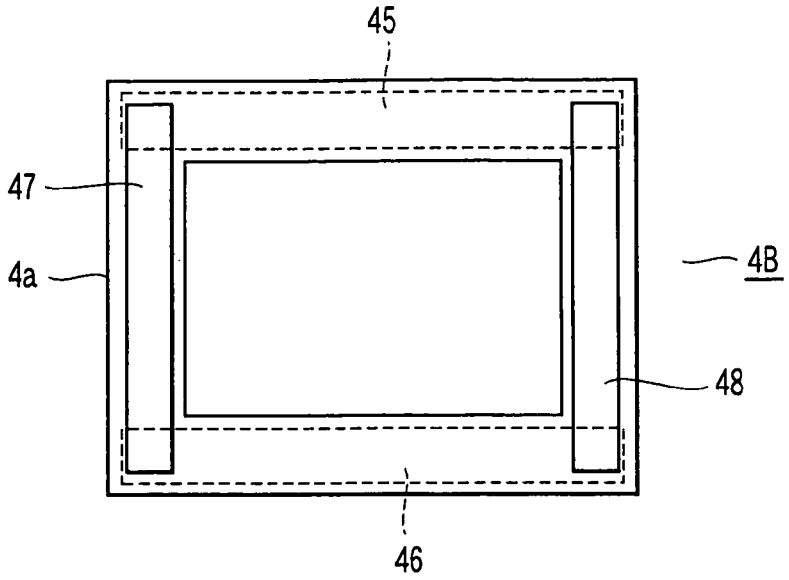
FIG. 9 is a plan view showing a loop antenna according to the second embodiment of the present invention.

FIG. 9 is a plan view showing a loop antenna according to the second embodiment of the present invention. In a loop antenna 4B according to this embodiment, of four conductive patterns 45 to 48 formed on a double-sided printed circuit board 4*a*, the conductive patterns 45 and 46 formed on a surface which opposes a printed circuit board 3*b* of a circuit unit 3 shown in FIG. 1 are set to be wider than the conductive patterns 47 and 48 formed on a surface which opposes a back cover 2.

Figure 10:
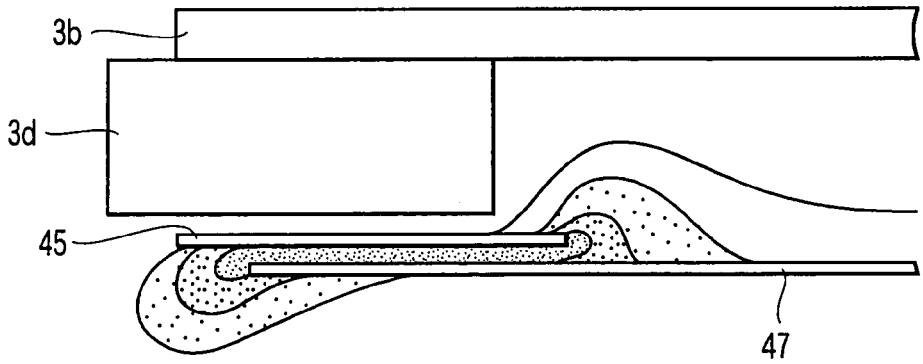
FIG. 10 is a view showing a near-field generation state at the overlap portion of the loop antenna shown in FIG. 9.

In this structure, as shown in FIG. 10, near-fields generated at the overlap portions between the conductive patterns 45 and 46 and the conductive patterns 47 and 48 are directed to the back cover 2 shown in FIG. 1 (to the lower side in FIG. 10) and are hardly directed to the printed circuit board 3*b* of the circuit unit 3 (to the upper side in FIG. 10). Even when a circuit component 3*d* is present between the loop antenna 4B and the printed circuit board 3*b* of the circuit unit 3, the adverse affect of the near-field on the circuit component 3*d* is reduced. As a result, any decrease in selectivity and degradation in tuning accuracy are prevented.

Figure 11:
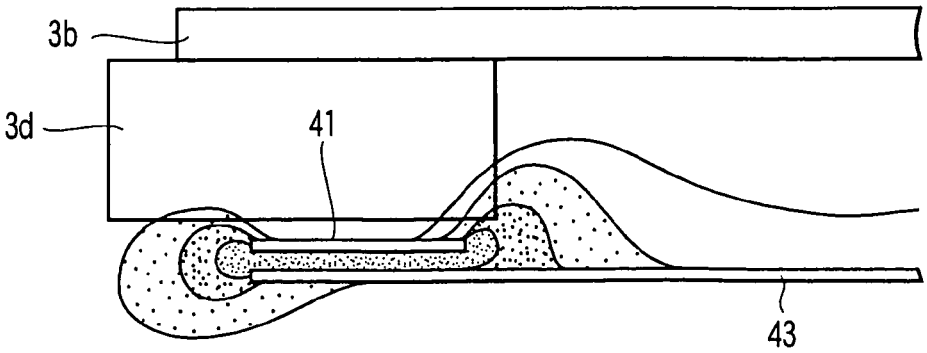
FIG. 11 is a view showing a near-field generation state at the overlap portion of the loop antenna in which the conductive patterns are set to the same width.

Assume that the conductive patterns formed on the surface opposing the printed circuit board 3*b* of the circuit unit 3 are set to the same width as that of the conductive patterns formed on the surface opposing the back cover 2. In this case, as shown in FIG. 11, near-fields generated at the overlap portions between the conductive patterns are also directed to the printed circuit board 3*b* of the circuit unit 3 (to the upper side in FIG. 11). For this reason, the circuit component 3*d* is readily adversely affected by the near-fields. A decrease in selectivity and degradation in tuning accuracy are unavoidable.

Third Embodiment

In the third embodiment of the present invention, an adjusting structure to adjust the overlap area is formed at an end portion of a segment. By using the adjusting structure, the overlap area is arbitrarily changed in adjustment during or after the manufacture of the loop antenna.

Figure 12:
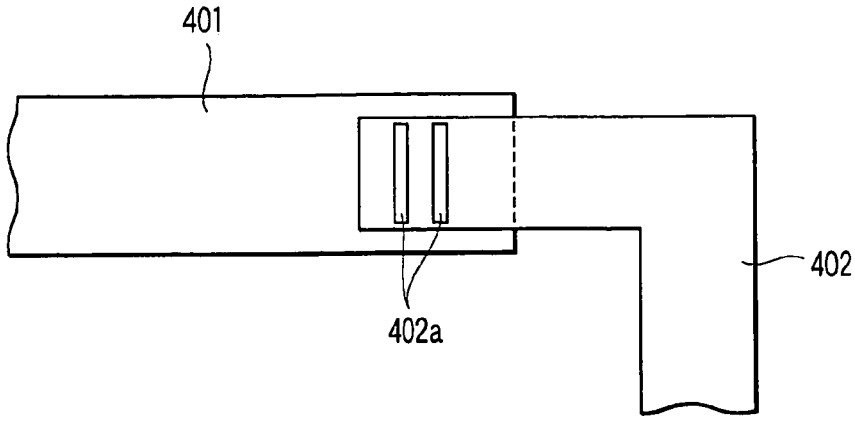
FIG. 12 is a view showing the first example of a loop antenna according to the third embodiment of the present invention.

FIG. 12 is a view showing the first example of the loop antenna according to the third embodiment of the present invention. A plurality of slits 402*a* long in the direction of width are formed at the center of an end portion of a segment 402. To adjust the overlap area between a segment 401 and the segment 402, the end portion of the segment 402 is cut at the position of an arbitrary slit 402*a*. Cutting can easily be done because of the presence of the slit 402*a*. Accordingly, the overlap area can be reduced by a simple operation.

Figure 13:
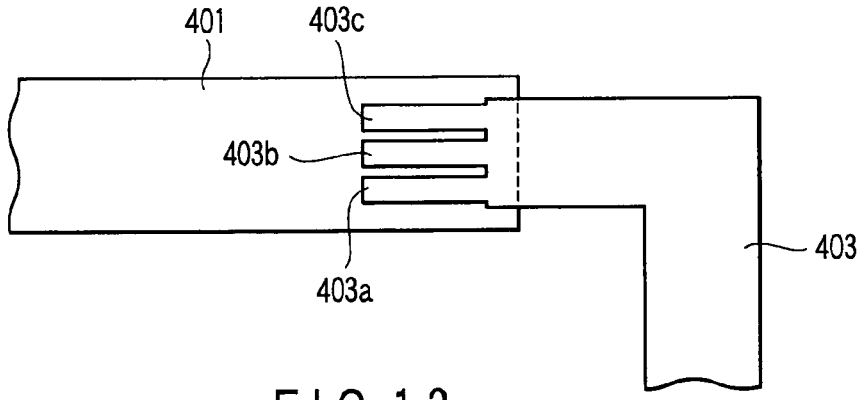
FIG. 13 is a view showing the second example of the loop antenna according to the third embodiment of the present invention.

FIG. 13 is a view showing the second example of the loop antenna according to the third embodiment of the present invention. A plurality of (three in FIG. 13) comb-shaped projections 403*a*, 403*b*, and 403*c* are formed at an edge of a segment 403. To adjust the overlap area between the segment 401 and the segment 403, an arbitrary projection (e.g., the projection 403*a*) is cut at its base. Cutting can easily be done because all the projections 403*a*, 403*b*, and 403*c* have a long shape. Accordingly, the overlap area can be reduced by a simple operation, as in the first example.

Figure 14:
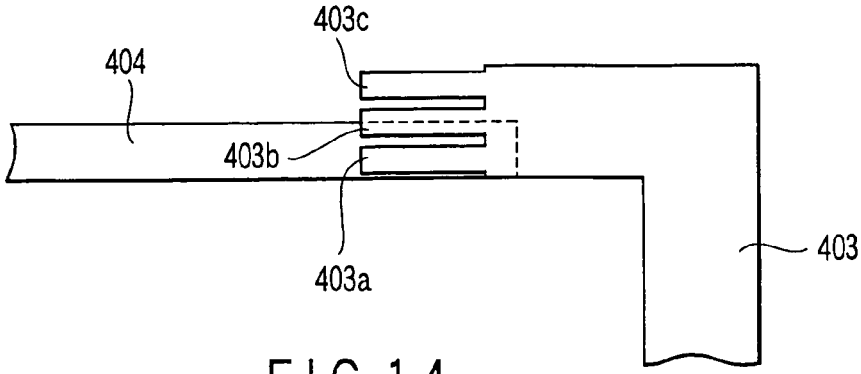
FIG. 14 is a view showing the third example of the loop antenna according to the third embodiment of the present invention.

FIG. 14 is a view showing the third example of the loop antenna according to the third embodiment of the present invention. A plurality of (three in FIG. 14) comb-shaped projections 403*a*, 403*b*, and 403*c* are formed at the edge of the segment 403, as in the second example. On the other hand, the width of a segment 404 which overlaps the segment 403 is set to be smaller than that of the segment 403.

In this structure, to adjust the overlap area between the segment 403 and the segment 404, of the projections 403*a*, 403*b*, and 403*c* of the segment 403, the projection 403*c* which does not overlap the segment 404 is cut. In this case, a current which is normally shunted to the projection 403*c* flows to the remaining projections 403*a* and 403*b*. Accordingly, the density of the current flowing to the overlap portion increases. This is equivalent to an increase in overlap area.

Fourth Embodiment

In the fourth embodiment of the loop antenna according to the present invention, various kinds of overlap structures will be described.

Figure 15:
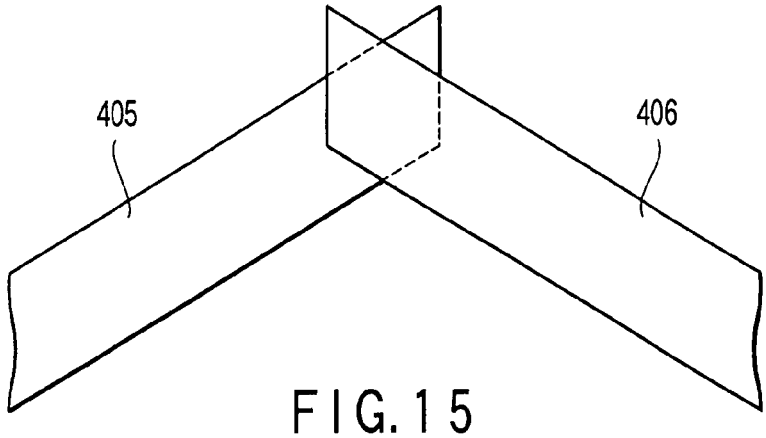
FIG. 15 is a view showing the first example of a loop antenna according to the fourth embodiment of the present invention.

FIG. 15 is a view showing the first example of the loop antenna according to the fourth embodiment of the present invention. In this example, the end portions of segments 405 and 406 are made to overlap not at a right angle but at an angle larger than 90°. This structure is used to form a loop antenna by, e.g., arranging a number of segments in a polygonal shape.

Figure 16:
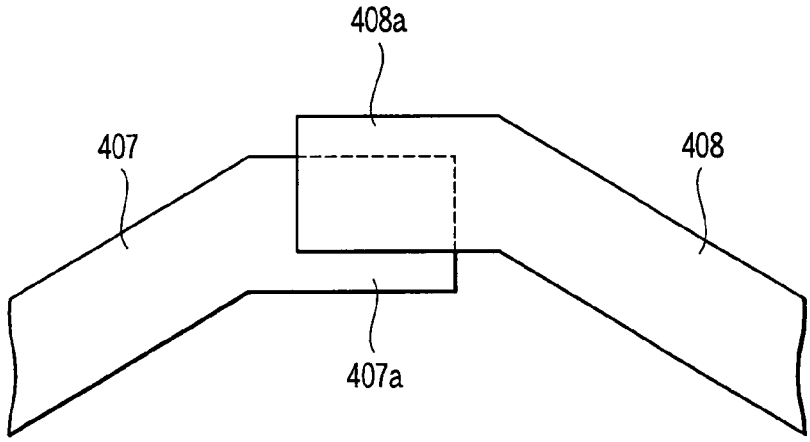
FIG. 16 is a view showing the second example of the loop antenna according to the fourth embodiment of the present invention.

FIG. 16 is a view showing the second example of the loop antenna according to the fourth embodiment of the present invention. This example is an improvement of the structure shown in FIG. 15. The end portions of segments 407 and 408 are bent in advance in accordance with the interior angle of a polygon. With this structure, the acute-angled projecting portions of the segments 407 and 408 at the overlap portion are reduced, as compared to the example shown in FIG. 15. For this reason, a current smoothly flows, and the current distribution becomes more uniform. Accordingly, the high-frequency characteristic can be improved.

Figure 17:
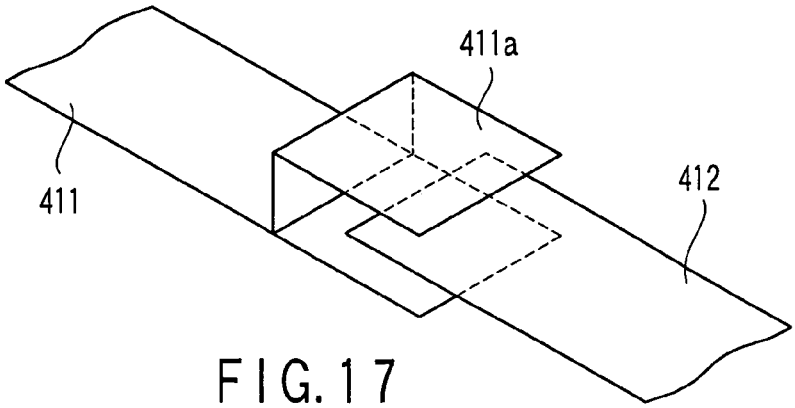
FIG. 17 is a view showing the third example of the loop antenna according to the fourth embodiment of the present invention.

FIG. 17 is a view showing the third example of the loop antenna according to the fourth embodiment of the present invention. In this example, a cantilever-shaped projecting portion 411*a* is formed at the end portion of one segment 411. The end portion of the other segment 412 is arranged and held in the gap between the end portion of the segment 411 and the projecting portion 411*a*. With this structure, the overlap area can be increased.

Figure 18:
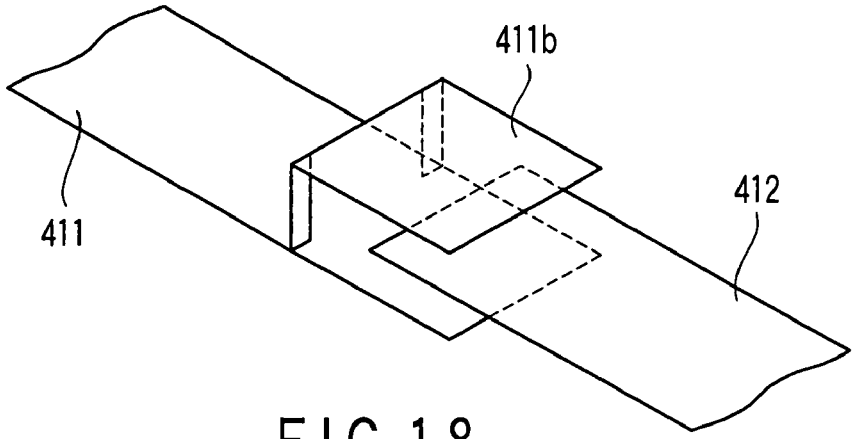
FIG. 18 is a view showing the fourth example of the loop antenna according to the fourth embodiment of the present invention.

FIG. 18 is a view showing the fourth example of the loop antenna according to the fourth embodiment of the present invention. This example is an improvement of the structure shown in FIG. 17. A cantilever-shaped projecting portion 411*b* at the end portion of the segment 411 is supported by two thin columns. In this structure, if the overlap area needs to be reduced, the projecting portion 411*b* can easily be removed.

Fifth Embodiment

In the fifth embodiment of a loop antenna according to the present invention, a loop antenna is formed by using segments having a shape except a rectangular shape.

Figure 19A:
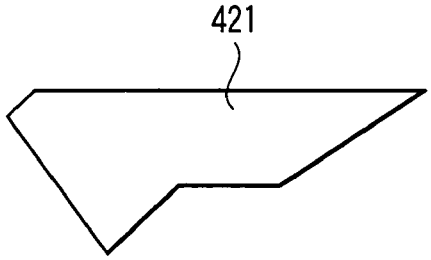
FIGS. 19A and 19B are views showing the first example of a loop antenna according to the fifth embodiment of the present invention.
Figure 19B:
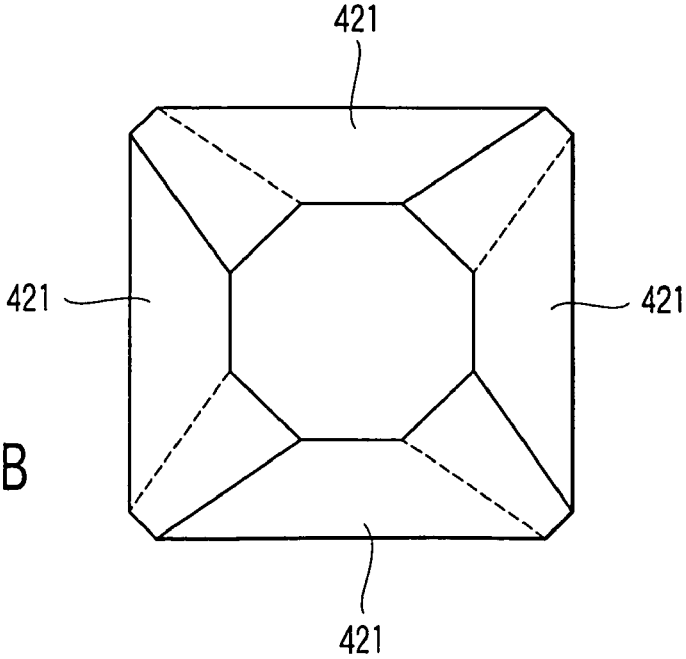

FIGS. 19A and 19B are views showing the first example of the loop antenna according to the fifth embodiment of the present invention. FIG. 19A shows one segment piece. FIG. 19B shows the structure of a loop antenna formed by using a plurality of (four in FIG. 19B) segment piece. A segment piece 421 has a shape of a combination of a plurality of triangles. When four segment pieces 421 having such a shape are arranged in a loop, a loop antenna having a square outer edge and an octagonal inner edge can be formed, as shown in FIG. 19B.

With this structure, a loop antenna in which the circumferential length changes between the outer edge and the inner edge, and the overlap amount changes between the outer periphery and the inner periphery can be formed. When the overlap amount on the outer periphery side and that on the inner periphery side are arbitrarily changed, the coupling capacitance between the segment pieces can be changed, and the current distribution can arbitrarily be set. For example, the current distribution on the outer periphery at the resonance frequency and that at the inner periphery at the resonance frequency can be made equal between the segment pieces. In addition, a loop antenna having multiple current distributions, and for example, a loop antenna having a current distribution of a 1-wavelength loop antenna at the inner periphery and the current distribution of a small circular loop antenna at the outer periphery can be provided.

Furthermore, the size of the hole at the central portion of the loop antenna can be adjusted in accordance with the size or shape of the circuit component arranged there. More specifically, the size of the hole at the central portion can be minimized while avoiding the circuit component. Accordingly, a broadband loop antenna can be formed while holding the degree of freedom in mounting.

Figure 20:
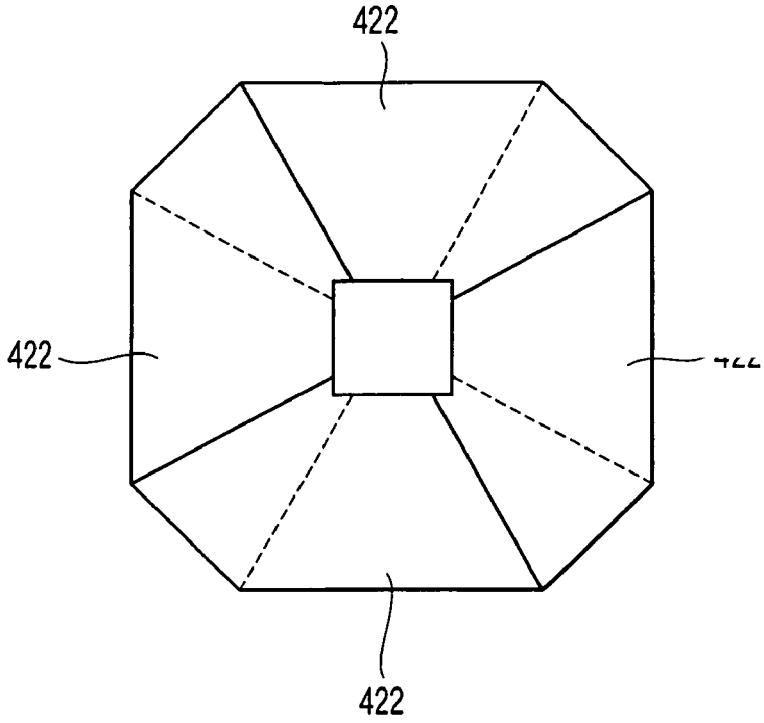
FIG. 20 is a view showing the second example of the loop antenna according to the fifth embodiment of the present invention.

FIG. 20 is a view showing the second example of the loop antenna according to the fifth embodiment of the present invention. In the loop antenna of this example, the overlap amount on the outer periphery side is larger than that on the inner periphery side. Even in this structure, the overlap amount on the outer periphery side and that on the inner periphery side can arbitrarily be changed, as in FIGS. 19A and 19B. Accordingly, a loop antenna having an arbitrary current distribution can be implemented.

Sixth Embodiment

In the sixth embodiment of the present invention, various kinds of feed circuits suitable for the loop antenna of the present invention will be described.

Figure 21:
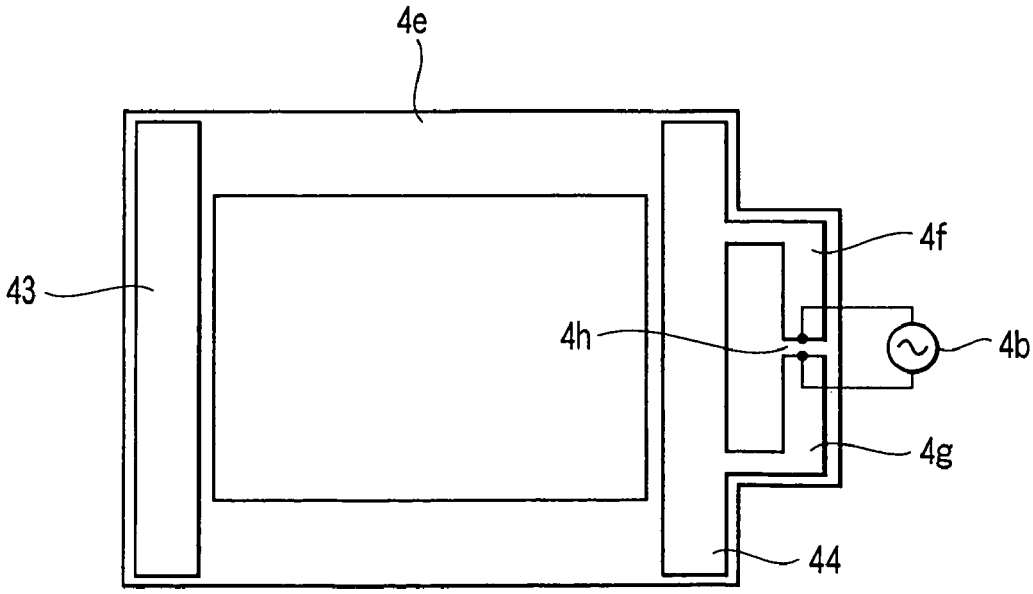
FIG. 21 is a view showing the first example of a loop antenna according to the sixth embodiment of the present invention.

FIG. 21 is a view showing the first example of the loop antenna according to the sixth embodiment of the present invention. The same reference numerals as in FIG. 2 denote the same parts in FIG. 21.

An extended portion is formed on one side of a double-sided printed circuit board 4*e*. L-shaped matching line patterns 4*f* and 4*g* which form an impedance matching circuit are formed on the extended portion. The proximal portions of the matching line patterns 4*f* and 4*g* are connected to a conductive pattern 44. The distal end portions of the matching line patterns 4*f* and 4*g* are located to oppose each other via a slit portion 4*h* at a predetermined interval. A pair of feed terminals are formed at the distal end portions of the matching line patterns 4*f* and 4*g*. The feed terminals are connected to a radio circuit 4*b* through a feed line pattern.

With this structure, impedance matching to the radio circuit 4*b* can more accurately be ensured. In addition, the matching line patterns 4*f* and 4*g* can be formed on the printed circuit board together with conductive patterns 41 to 44 simultaneously in one step.

Figure 22:
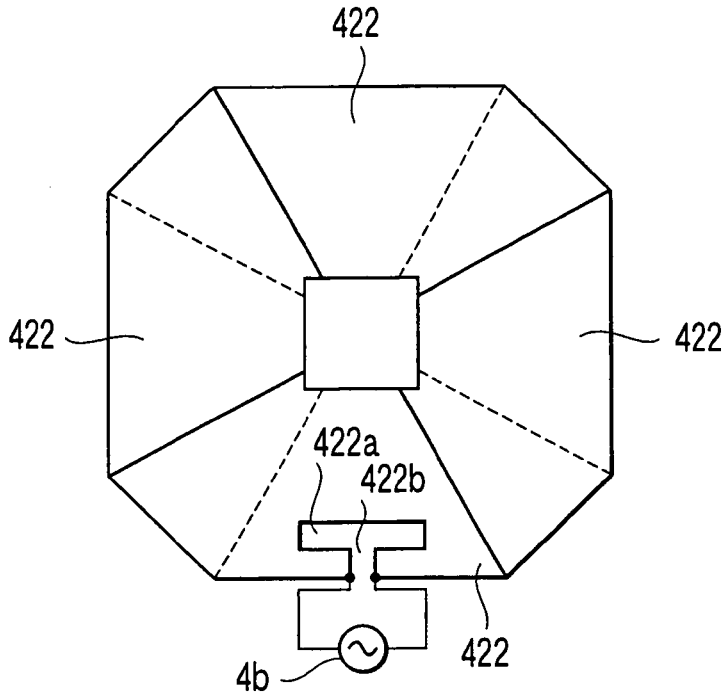
FIG. 22 is a view showing the second example of the loop antenna according to the sixth embodiment of the present invention.

FIG. 22 is a view showing the second example of the loop antenna according to the sixth embodiment of the present invention. The same reference numerals as in FIG. 20 denote the same parts in FIG. 22. A slot 422*a* having a keyhole-shaped slit 422*b* is formed in one segment piece 422. A pair of feed terminals are formed at two end portions of the slit 422*b*. The feed terminals are connected to the radio circuit 4*b* through a feed line pattern. With this structure, even in the loop antenna whose circumferential length changes between the outer edge and the inner edge, impedance matching to the radio circuit 4*b* can more reliably be ensured.

Figure 23:
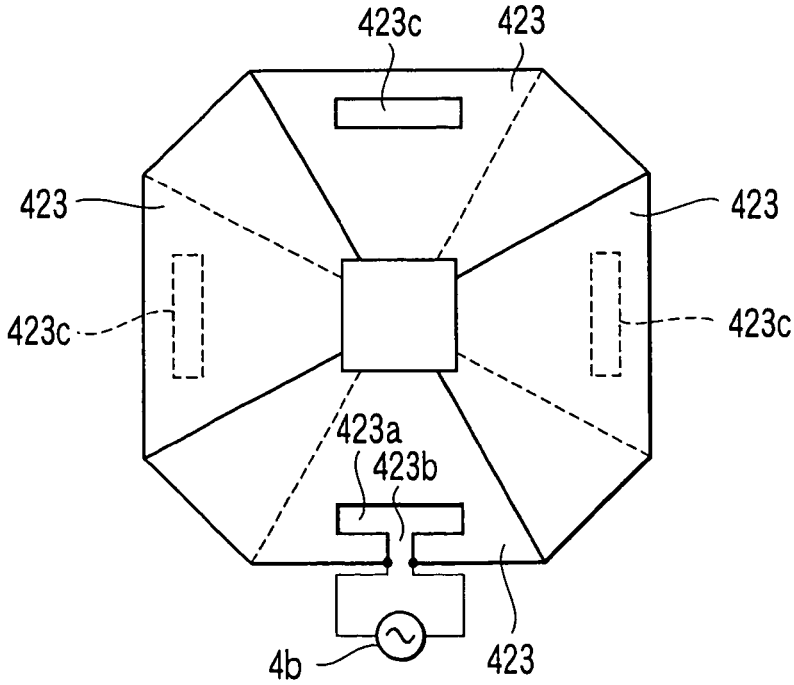
FIG. 23 is a view showing the third example of the loop antenna according to the sixth embodiment of the present invention.

FIG. 23 is a view showing the third example of the loop antenna according to the sixth embodiment of the present invention. A slot 423*c* for impedance matching is formed in each of four segment pieces 423. One of the slots 423*c* has a slit 423*b* similar to that shown in FIG. 22. A pair of feed terminals are formed at two end portions of the slit 422*b*. The feed terminals are connected to the radio circuit 4*b* through a feed line pattern. With this structure, in the loop antenna whose overlap amount changes between the outer periphery side and the inner periphery side, optimum impedance matching can be ensured for each segment piece 423.

Figure 24:
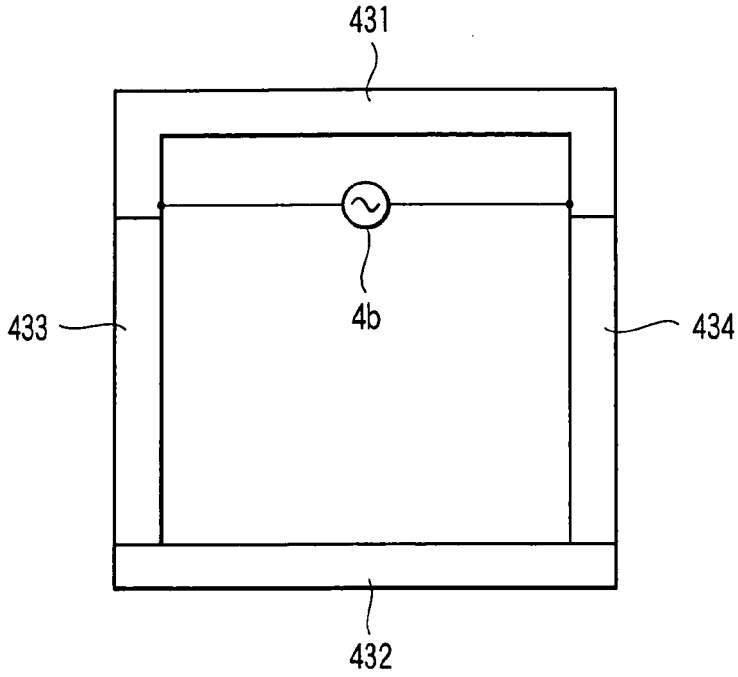
FIG. 24 is a view showing the fourth example of the loop antenna according to the sixth embodiment of the present invention.

FIG. 24 is a view showing the fourth example of the loop antenna according to the sixth embodiment of the present invention. In this example, in a loop antenna formed by arranging four segment pieces 431 to 434 in a square, one segment piece 431 has a U shape, and a pair of feed terminals are formed at two end portions of the segment piece 431. The feed terminals are connected to the radio circuit 4*b* through a feed line pattern. With this structure, impedance matching to the radio circuit 4*b* can be set high. Accordingly, impedance matching can be ensured without separately preparing a matching circuit.

Figure 25:
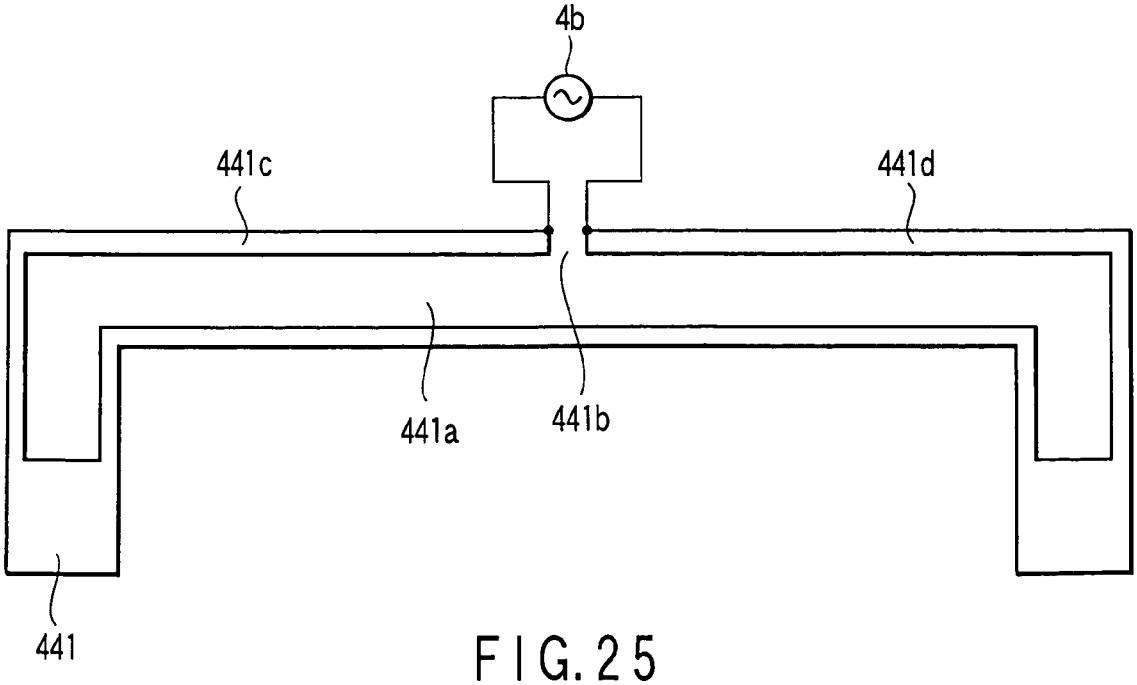
FIG. 25 is a view showing the fifth example of the loop antenna according to the sixth embodiment of the present invention.

FIG. 25 is a view showing the fifth example of the loop antenna according to the sixth embodiment of the present invention. FIG. 25 is an enlarged view of the U-shaped segment piece 431 shown in FIG. 24. In this example, a U-shaped slot 441*a* is formed n a U-shaped segment piece 441. A slit 441*b* is formed at the central portion between segment piece peripheral portions 441*c* and 441*d* which are left after formation of the slot 441*a*. A pair of feed terminals are formed at two end portions of the slit 441*b*. The feed terminals are connected to the radio circuit 4*b* through a feed line pattern.

With this structure, impedance matching to the radio circuit 4*b* can be set higher. Accordingly, impedance matching can be ensured without separately preparing a matching circuit.

Figure 26:
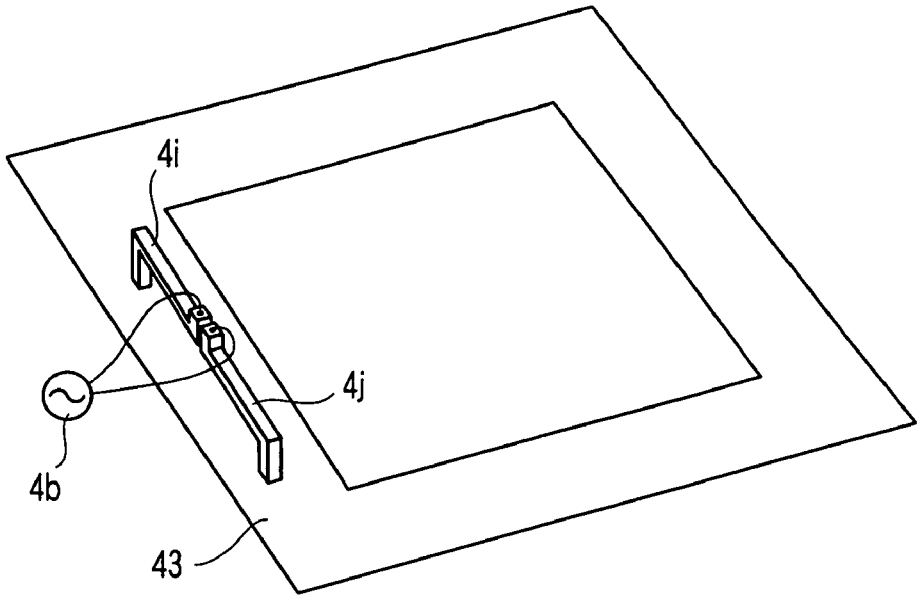
FIG. 26 is a view showing the sixth example of the loop antenna according to the sixth embodiment of the present invention.

FIG. 26 is a view showing the sixth example of the loop antenna according to the sixth embodiment of the present invention. A pair of crank-shaped matching lines 4*i* and 4*j* stand on the center line in the longitudinal direction of a conductive pattern 43. The proximal portions of the matching lines 4*i* and 4*j* are electrically connected to the conductive pattern 43. The distal end pieces of the matching lines 4*i* and 4*j* are located to oppose each other at a predetermined interval. A pair of feed terminals are formed at the distal end pieces of the matching lines 4*i* and 4*j*. The feed terminals are connected to the radio circuit 4*b* through a feed line pattern.

With this structure, impedance matching to the radio circuit 4*b* can accurately be ensured, as a matter of course. Additionally, generation of a radiation pattern in a direction perpendicular to the loop antenna plane by the matching lines 4*i* and 4*j* can be reduced. Accordingly, the influence of the radio wave on a human body can be reduced.

When the matching circuit is present in the same plane as the main loop of the antenna, as shown in FIG. 26, the current which flows to the closed loop of the matching circuit is larger than the current which flows to the closed loop of the main antenna. In this case, a radiation pattern is formed in a direction perpendicular to the loop antenna plane by the closed loop current in the matching circuit. This radiation pattern may influence the human body and degrade the tuning accuracy in the free space.

When the matching lines 4*i* and 4*j* are formed along the center line of the conductive pattern, as shown in FIG. 26, formation of the radiation pattern in a direction perpendicular to the loop antenna plane by the closed loop current in the matching circuit can be prevented. Hence, influence of the radiation pattern on the human body can be suppressed, and the tuning accuracy in the free space can be held high.

Other Embodiments

In the above-described embodiments, an overlap structure is implemented by using a double-sided printed circuit board. However, the present invention is not limited to this. An overlap structure may be implemented on a single-sided printed circuit board.

Figure 27:
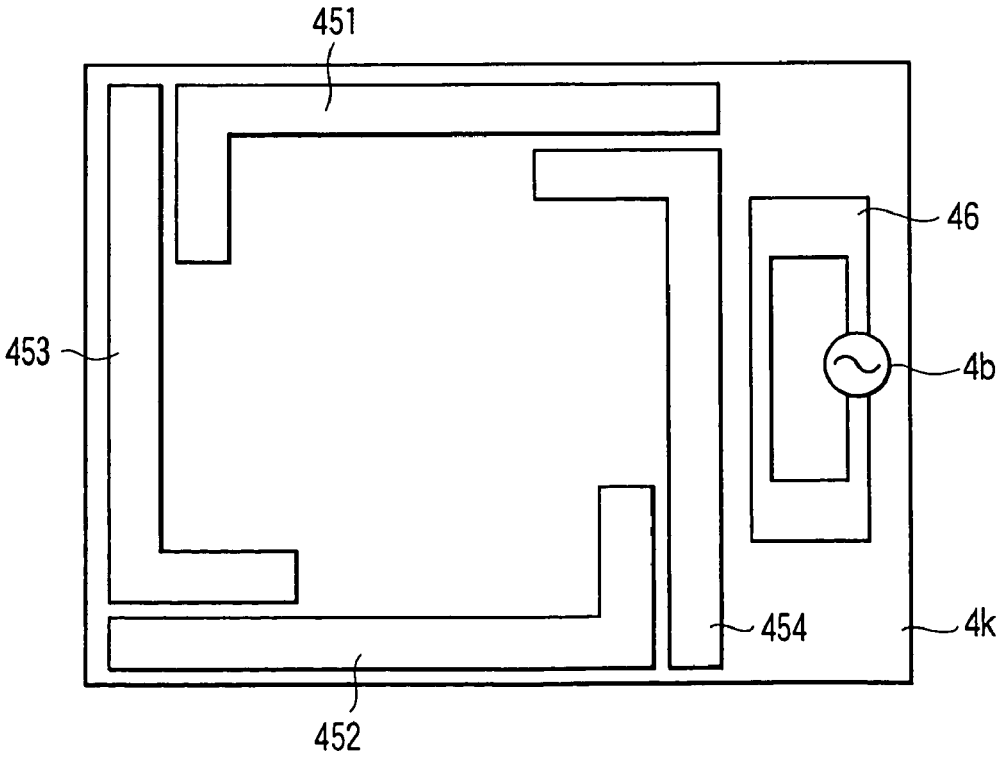
FIG. 27 is a plan view showing the structure of a loop antenna according to other embodiments of the present invention.

FIG. 27 shows an example of the structure. Four L-shaped conductive patterns 451 to 454 are arranged in a square to form a loop on a single-sided printed circuit board 4*k*. One end portion of each of the conductive patterns 451 to 454 is located to oppose the other end portion of an adjacent conductive pattern at a predetermined interval. The coupling capacitance between the conductive patterns 451 to 454 is determined by the interval and the length of the opposite portions. A C-shaped conductive pattern 46 is formed at a position opposite to the conductive pattern 454 while being separated by a predetermined distance. Two end portions of the conductive pattern 46 are connected to a radio circuit 4*b*.

With this structure, an in-plane overlap structure and a noncontact feed circuit are implemented. The overlap structure using the single-sided printed circuit board does not require mounting of a delicate circuit component, like the above-described overlap structure using a double-sided printed circuit board, and can therefore be made thin like a sheet. In addition, since soldering is unnecessary, manufacture is easy, and a flexible loop antenna using a flexible board can be manufactured.

In the above-described embodiments, loop antennas using a printed circuit board have been described. However, the present invention is not limited to this. A loop antenna may be manufactured by using, e.g., a laminate coating or resin integral molding (MID) instead of using a printed circuit board. As a feed method, not unbalanced feed but balanced feed which executes power supply between segments and a ground terminal may be employed.

For the shapes and number of segments, the structure of the capacitive coupling portion, and the structure of the feed circuit, various changes and modifications can be made as well without departing from the spirit and scope of the present invention.

The present invention is not limited to the above-described embodiments, and in practicing the present invention, various changes and modifications can be made for the constituent elements without departing from the spirit and scope of the invention. In addition, various inventions can be implemented by appropriately combining a plurality of constituent elements disclosed in the embodiments. For example, some of constituent elements disclosed in the embodiments may be omitted. Alternatively, constituent elements in different embodiments may be combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A loop antenna comprising:

a plurality of segments which are arranged in a loop;

a coupling medium which capacitively couples the plurality of segments; and a circuit to connect a feed circuit to only one of the plurality of segments.

2. A loop antenna comprising:

a plurality of segments which are arranged in a loop such that end portions of adjacent ones of the segments overlap at overlap portions;

a dielectric medium which is inserted between the overlapping end portions of the plurality of segments to capacitively couple the plurality of segments; and a circuit to connect a feed circuit to only one of the plurality of segments.

3. The antenna according to claim 2, wherein the plurality of segments include a plurality of plate-shaped conductors, which are arranged to form a polygon such that end portions of adjacent ones of the conductors overlap.

4. The antenna according to claim 2, wherein the dielectric medium comprises a double-sided printed circuit board, the plurality of segments include a plurality of conductive patterns distributed to a first surface and a second surface of the double-sided printed circuit board, and adjacent ones of the plurality of conductive patterns overlap at overlap portions which comprise end portions of the adjacent conductive patterns that oppose each other via the double-sided printed circuit board.

5. The antenna according to claim 2, wherein the plurality of segments include a plurality of conductive patterns arranged in a loop on a same plane of a printed circuit board, adjacent ones of the plurality of conductive patterns overlap at overlap portions which oppose each other at a predetermined interval in a direction parallel to a surface of the printed circuit board, and the dielectric medium comprises air gaps which are present at the overlap portions of the plurality of conductive patterns.

6. The antenna according to claim 2, wherein at each of the overlap portions, a first one of the adjacent segments is narrower than a second one of the adjacent segments.

7. The antenna according to claim 2, wherein the plurality of segments include an area adjusting structure to adjust an overlap area at each overlap portion.

8. The antenna according to claim 2, wherein the circuit to connect the feed circuit comprises a pair of L-shaped matching lines which have proximal portions connected to the one segment and distal end portions separated by a predetermined interval, and a feed line which connects the feed circuit between the distal end portions of the pair of matching lines.

9. The antenna according to claim 2, wherein the circuit to connect the feed circuit comprises a pair of crank-shaped matching lines which stand in a direction perpendicular to the one segment and have proximal portions connected to the segment and distal end portions separated by a predetermined interval, and a feed line which connects the feed circuit between the distal end portions of the pair of matching lines.

10. A radio communication device comprising:

a housing;

a printed circuit board which is accommodated in the housing;

a circuit component which is mounted on the printed circuit board; and a loop antenna which is arranged in the housing and overlaps the printed circuit board; wherein the loop antenna comprises:

a plurality of segments which are arranged in a loop around the circuit component;

a capacitive coupling medium which capacitively couples the plurality of segments; and a circuit which connects a feed circuit to only one of the plurality of segments.

11. A radio communication device comprising:

a housing;

a printed circuit board which is accommodated in the housing;

a circuit component which is mounted on the printed circuit board; and a loop antenna which is arranged in the housing and overlaps the printed circuit board;

wherein the loop antenna comprises;

a plurality of segments which are arranged in a loop around the circuit component such that end portions of adjacent ones of the segments overlap at overlap portions;

a dielectric medium which is inserted between the overlapping end portions of the plurality of segments to capacitively couple the plurality of segments; and a circuit to connect a feed circuit to only one of the plurality of segments.

12. The device according to claim 11, wherein the plurality of segments include four plate-shaped conductors, which are arranged to form a square around the circuit component such that end portions of adjacent ones of the conductors overlap.

13. The device according to claim 11, wherein the dielectric medium comprises a double-sided printed circuit board, the plurality of segments include a plurality of conductive patterns distributed to a first surface and a second surface of the double-sided printed circuit board, and adjacent ones of the plurality of conductive patterns overlap at overlap portions which comprise end portions of the adjacent conductive patterns that oppose each other via the double-sided printed circuit board.

14. The device according to claim 11, wherein at each of the overlap portions, a first one of the adjacent segments is narrower than a second one of the adjacent segments.

15. The device according to claim 14, wherein the second, wider, segment arranged closer to the circuit component than the first, narrower, segment.

16. The device according to claim 11, wherein the plurality of segments include an area adjusting structure to adjust an overlap area at each overlap portion.

17. The device according to claim 11, wherein the circuit to connect the feed circuit comprises a pair of L-shaped matching lines which have proximal portions connected to the one segment and distal end portions separated by a predetermined interval, and a feed line which connects the feed circuit between the distal end portions of the pair of matching lines.

18. The device according to claim 11, wherein the circuit to connect the feed circuit comprises a pair of crank-shaped matching lines which stand in a direction perpendicular to the one segment and have proximal portions connected to the segment and distal end portions separated by a predetermined interval, and a feed line which connects the feed circuit between the distal end portions of the pair of matching lines.

* * * * *